US007040086B2

(12) United States Patent
Kitahara et al.

(10) Patent No.: US 7,040,086 B2
(45) Date of Patent: May 9, 2006

(54) EXHAUST EMISSION CONTROL SYSTEM OF INTERNAL COMBUSTION ENGINE

(75) Inventors: Yasuhisa Kitahara, Yokohama (JP); Takashi Shirakawa, Yokohama (JP); Manabu Miura, Kanagawa (JP)

(73) Assignee: Nissan Motor Co., Ltd., Yokohama (JP)

( * ) Notice: Subject to any disclaimer, the term of this patent is extended or adjusted under 35 U.S.C. 154(b) by 0 days.

(21) Appl. No.: 10/828,436

(22) Filed: Apr. 21, 2004

(65) Prior Publication Data

US 2004/0226284 A1 Nov. 18, 2004

(30) Foreign Application Priority Data

May 15, 2003 (JP) ..... 2003-137748

(51) Int. Cl.
*F01N 3/00* (2006.01)

(52) U.S. Cl. ..... 60/285; 60/274; 60/276; 60/278; 60/286; 60/297; 60/311

(58) Field of Classification Search ..... 60/274, 60/276, 278, 285, 286, 297, 311, 295; 422/169, 422/171, 177; 423/212, 213.7, 239.1
See application file for complete search history.

(56) References Cited

U.S. PATENT DOCUMENTS

| | | | | |
|---|---|---|---|---|
| 5,473,887 | A | 12/1995 | Takeshima et al. | |
| 5,746,989 | A * | 5/1998 | Murachi et al. | 423/213.7 |
| 5,974,791 | A * | 11/1999 | Hirota et al. | 60/276 |
| 6,233,927 | B1 * | 5/2001 | Hirota et al. | 60/297 |
| 6,253,543 | B1 * | 7/2001 | Russell | 60/274 |
| 6,574,956 | B1 | 6/2003 | Moraal et al. | |
| 6,718,757 | B1 * | 4/2004 | Khair et al. | 60/286 |
| 6,843,054 | B1 * | 1/2005 | Taylor et al. | 60/275 |
| 6,863,874 | B1 * | 3/2005 | Twigg | 423/210 |
| 2001/0052232 | A1 | 12/2001 | Hoffmann et al. | |
| 2003/0200745 | A1 * | 10/2003 | van Nieuwstadt et al. | 60/295 |
| 2004/0123584 | A1 | 7/2004 | Schaller | |
| 2005/0086933 | A1 * | 4/2005 | Nieuwstadt et al. | 60/297 |

FOREIGN PATENT DOCUMENTS

| | | | |
|---|---|---|---|
| DE | 100 23 439 | A1 | 11/2001 |
| DE | 101 08 720 | A1 | 9/2002 |
| DE | 101 44 958 | A1 | 3/2003 |
| EP | 1 086 741 | A2 | 3/2001 |
| EP | 1 203 869 | A1 | 5/2002 |
| JP | 2600492 | B2 | 1/1997 |
| JP | 2722987 | B2 | 11/1997 |
| JP | 2727906 | B2 | 12/1997 |

* cited by examiner

*Primary Examiner*—Tu M. Nguyen
(74) *Attorney, Agent, or Firm*—Foley & Lardner LLP

(57) ABSTRACT

An exhaust purifying device is arranged in an exhaust gas passage extending from an internal combustion engine. The exhaust purifying device includes a NOx trapping catalyst that traps NOx in the exhaust gas when an exhaust air/fuel ratio is leaner than stoichiometric and releases the trapped NOx therefrom when the exhaust air/fuel ratio is richer than stoichiometric, and a particulate filter that collects a particulate matter in the exhaust gas. A condition detecting device is arranged to detect a condition of the particulate filter. An exhaust air/fuel ratio control device is arranged to control the exhaust gas from the engine in such a manner that the exhaust gas has a target exhaust air/fuel ratio. When the exhaust air/fuel ratio is changed from a stoichiometric or richer side to a leaner side, the exhaust air/fuel ratio control device varies the exhaust air/fuel ratio under the leaner air/fuel exhaust condition in accordance with the condition of the particulate filter.

11 Claims, 14 Drawing Sheets

EXHAUST EMISSION CONTROL SYSTEM OF INTERNAL COMBUSTION ENGINE

BACKGROUND OF THE INVENTION

1. Field of the Invention

The present invention relates in general to exhaust emission control systems of internal combustion engines, and more particularly to the exhaust emission control systems of a type that is suitable for a diesel engine. More specifically, the present invention relates to the exhaust emission control systems of a type that includes a NOx trapping catalytic converter that traps nitrogen oxides (NOx) in the exhaust gas when the exhaust air/fuel ratio is high (viz., lean) and releases the trapped NOx from the catalytic converter when the exhaust air/fuel ratio is low (viz., rich), and a diesel particulate filter (DPF) that collects particulate matter (PM) in the exhaust gas.

2. Description of the Related Art

Hitherto, various exhaust emission control systems of the above-mentioned type have been proposed and put into practical use particularly in the field of wheeled motor vehicles powered by a diesel engine. Some of them are disclosed in Japanese Patents 2722987 and 2727906.

In the systems of these patents, there is employed such a measure that once the NOx trapping catalytic converter completes the releasing of the trapped NOx therefrom, burning of the particulate matter (PM) collected by the diesel particulate filter (DPF) starts. In other words, regeneration of the diesel particulate filter (DPF) starts after completion of regeneration of the NOx trapping catalytic converter.

SUMMARY OF THE INVENTION

When a careful consideration is given to above-mentioned known emission control systems, the following facts have been revealed by the inventors, that are latently possessed by the known emission control systems and tend to shorten the life of the diesel particulate filter (DPF). That is, in order to regenerate the NOx trapping catalytic converter, richer exhaust air/fuel ratio is provided, which produces a highly heated exhaust gas. Thus, just after completion of the regeneration of the NOx trapping catalytic converter, the diesel particulate filter (DPF) shows a very high temperature. If, under this condition, the exhaust air/fuel ratio is turned lean for restarting trapping of NOx by the NOx trapping catalytic converter, burning of the particulate matter (PM) that has been collected by the diesel particulate filter (DPF) is violently made, which lowers the durability of the filter (DPF) that is, shortens the life of the filter. This phenomenon is much marked particularly when the filter (DPF) has collected a large amount of particulate matter (PM).

It is therefore an object of the present invention to provide an exhaust emission control system of an internal combustion engine, which is free of the above-mentioned drawback.

In accordance with a first aspect of the present invention, there is provided an exhaust emission control system of an internal combustion engine, which comprises an exhaust purifying device arranged in an exhaust gas passage extending from the engine, the exhaust purifying device including a NOx trapping catalyst that traps NOx in the exhaust gas when an exhaust air/fuel ratio is leaner than stoichiometric and releases the trapped NOx therefrom when the exhaust air/fuel ratio is richer than stoichiometric, and a particulate filter that collects a particulate matter in the exhaust gas; a condition detecting device that detects a condition of the particulate filter; and an exhaust air/fuel ratio control device that controls the exhaust gas from the engine in such a manner that the exhaust gas has a target exhaust air/fuel ratio, wherein the exhaust air/fuel ratio control device is configured to carry out upon changing of the exhaust air/fuel ratio from a stoichiometric or richer side to a leaner side, varying the exhaust air/fuel ratio under the leaner air/fuel exhaust condition in accordance with the condition of the particulate filter.

In accordance with a second aspect of the present invention, there is provided an exhaust emission control system of a diesel engine, which comprises a NOx trapping catalyst arranged in an exhaust gas passage extending from the engine, the NOx trapping catalyst trapping NOx in the exhaust gas when an exhaust air/fuel ratio is leaner than stoichiometric and releasing the trapped NOx therefrom when the exhaust air/fuel ratio is richer than stoichiometric; a diesel particulate filter arranged in the exhaust gas passage at a position downstream of the NOx trapping catalyst, the diesel particulate filter collecting a particulate matter in the exhaust gas; a first temperature sensor that detects a temperature of the NOx trapping catalyst; a second temperature sensor that detects a temperature of the diesel particulate filter; an exhaust pressure sensor that detects an exhaust pressure exerted in the exhaust gas passage between the NOx trapping catalyst and the diesel particulate filter; an air/fuel ratio sensor that senses an exhaust air/fuel ratio of the exhaust gas discharged from the diesel particulate filter; an exhaust air/fuel ratio controller that is capable of varying the exhaust air/fuel ratio when operated; and a control unit that controls the operation of the exhaust air/fuel ratio controller by processing information signals from the first and second temperature sensors, the exhaust pressure sensor and the air/fuel ration sensor, the control unit being configured to carry out, upon sensing a change of the exhaust air/fuel ratio from a stoichiometric or richer side to a leaner side by the exhaust air/fuel ratio controller, varying the exhaust air/fuel ratio under the leaner air/fuel exhaust condition in accordance with at least one of the information signal from the second temperature sensor and the information signal from the exhaust pressure sensor.

In accordance with a third aspect of the present invention, there is provided, in an internal combustion engine system comprising an exhaust purifying device arranged in an exhaust gas passage extending from the engine, the exhaust purifying device including a NOx trapping catalyst that traps NOx in the exhaust gas when an exhaust air/fuel ratio is leaner than stoichiometric and releases the trapped NOx therefrom when the exhaust air/fuel ratio is richer than stoichiometric, and a particulate filter that collects a particulate matter in the exhaust gas; a condition detecting device that detects a condition of the particulate filter; and an exhaust air/fuel ratio control device that controls the exhaust gas from the engine in such a manner that the exhaust gas has a target exhaust air/fuel ratio, a method for controlling the exhaust air/fuel ratio control device. The method comprises detecting a change of the exhaust air/fuel ratio from a stoichiometric or richer side to a leaner side; and forcing the exhaust air/fuel ration control device to vary the exhaust air/fuel ratio under the leaner air/fuel exhaust condition in accordance with the condition of the particulate filter.

DETAILED DESCRIPTION OF THE INVENTION

Figure 1:
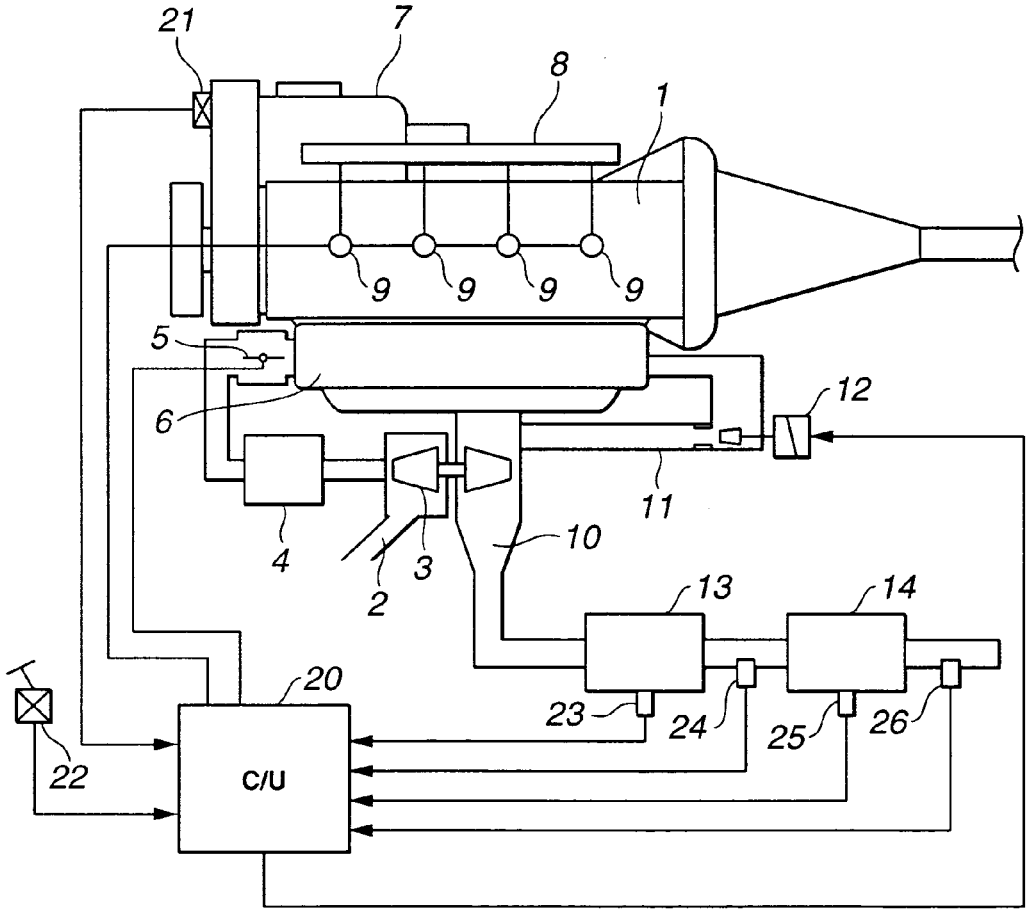
FIG. 1 is a schematic view of an exhaust emission control system of a diesel engine, to which the present invention is practically applied.

Referring to FIG. 1, there is schematically shown an exhaust emission control system of a diesel engine, to which the present invention is practically applied.

In the drawing, the diesel engine is denoted by numeral 1. In an air intake passage 2 of the engine 1, there is operatively installed an intake compressor of a variable nozzle type turbocharger 3. Thus, air led into intake passage 2 is supercharged by the intake compressor, cooled by an inter cooler 4 and fed to combustion chambers of cylinders of engine 1 through a throttle valve 5 and a collector 6.

Fuel is fed to the combustion chambers by a common rail type fuel injection device. That is, the fuel is pressurized by a high pressure fuel pump 7, led to a common rail 8 and directly injected into the combustion chambers of the cylinders through respective fuel injection valves 9. Air led into each combustion chamber and fuel injected into the combustion chamber are mixed and burnt by means of a compression ignition, and an exhaust gas thus produced in the combustion chamber is led into an exhaust passage 10.

A part of the exhaust gas led into exhaust passage 10 is returned, as an EGR gas, to the intake side of the engine 1 through an EGR passage 11 and an EGR valve 12. The remaining part of the exhaust gas is directed toward a tail pipe (not shown) while driving an exhaust turbine of the above-mentioned variable nozzle type turbocharger 3.

As shown, at a downstream portion of exhaust passage 10, there is arranged a NOx trapping catalytic converter 13 that traps NOx in the exhaust gas when an exhaust air/fuel ratio is lean and releases the trapped NOx from the NOx trapping catalyst (13) when the exhaust air/fuel ratio is rich. The NOx trapping catalyst (13) carries an oxidation catalyst (viz., precious metal catalyst) that has a function to oxidize hydrocarbon (HC) and carbon monoxide (CO) in the exhaust gas.

As shown in FIG. 1, exhaust passage 10 has at a portion downstream of NOx trapping catalytic converter 13 a diesel particulate filter (DPF) 14 that collects particulate matter (PM) in the exhaust gas. Also this filter (DPF) 14 carries an oxidation catalyst (viz., precious metal catalyst) and thus can oxidize HC and CO in the exhaust gas.

If desired, diesel particulate filter 14 may be arranged upstream of NOx trapping catalytic converter 13. Furthermore, if desired, these two devices 13 and 14 may be combined. That is, diesel particulate filter 14 may carry the NOx trapping catalyst (13).

Denoted by numeral 20 is a control unit for controlling operation of engine 1. Control unit 20 comprises a microcomputer that generally comprises a central processing unit (CPU), a random access memory (RAM), a read only memory (ROM) and input and output interfaces.

As shown, information signals that represent an engine speed "Ne" and an accelerator depression degree (viz., throttle open degree) "APO" are inputted to control unit 20 from an engine speed sensor 21 and an accelerator depression sensor 22, respectively.

Furthermore, information signals are inputted to control unit 20 from a NOx trapping catalyst temperature sensor 23, an exhaust pressure sensor 24, a DPF temperature sensor 25 and an air/fuel ratio sensor 26. As is understood from the drawing, catalyst temperature sensor 23 detects the temperature of the NOx trapping catalyst (13), exhaust pressure sensor 24 detects an exhaust pressure exerted in exhaust passage 10 between NOx trapping catalytic converter 13 and diesel particulate filter 14, DPF temperature sensor 25 detects the temperature of diesel particulate filter 14 and air/fuel ratio sensor 26 detects an exhaust air/fuel ratio possessed by exhaust gas that is discharged from diesel particulate filter 14. In the following, the exhaust air/fuel ratio will be referred to "exhaust-λ" that represents an excess air ratio.

If desired, the temperature of NOx trapping catalyst (13) and that of diesel particulate filter 14 may be indirectly measured or estimated by providing their downstream portions with respective temperature sensors (not shown).

Upon processing the above-mentioned information signals fed thereto, control unit 20 outputs a so-called "fuel injection instruction signal" to each of the fuel injection valves 9, a so-called "throttle valve open degree instruction signal" to throttle valve 5 and a so-called "EGR valve open degree instruction signal" to EGR valve 12. That is, the fuel injection instruction signal is arranged to control a fuel injection quantity and a fuel injection timing in each of a main fuel injection and a post fuel injection. As is known in the art, the post fuel injection is a fuel injection that is carried out during an expansion or exhaust stroke after the main fuel injection under a given operation condition of the engine 1.

Control unit 20 is configured to carry out an exhaust emission control by which particulate matter (PM) collected by diesel particulate filter 14 is purified (which will be referred to "DPF-regeneration" hereinafter), NOx trapped by NOx trapping catalytic converter 13 is purified (which will be referred to "NOx-regeneration" hereinafter) and SOx deposited on the NOx trapping catalyst (13) is purified (which will be referred to "SOx-regeneration" hereinafter). As is know to those skilled in the art, due to the nature of the exhaust gas, the NOx trapping catalyst (13) is subjected to a troublesome SOx poisoning.

In the following, the exhaust emission control carried out by control unit 20 will be described in detail with reference to flowcharts shown in FIGS. 2 to 12 of the accompanying drawings.

Figure 2:
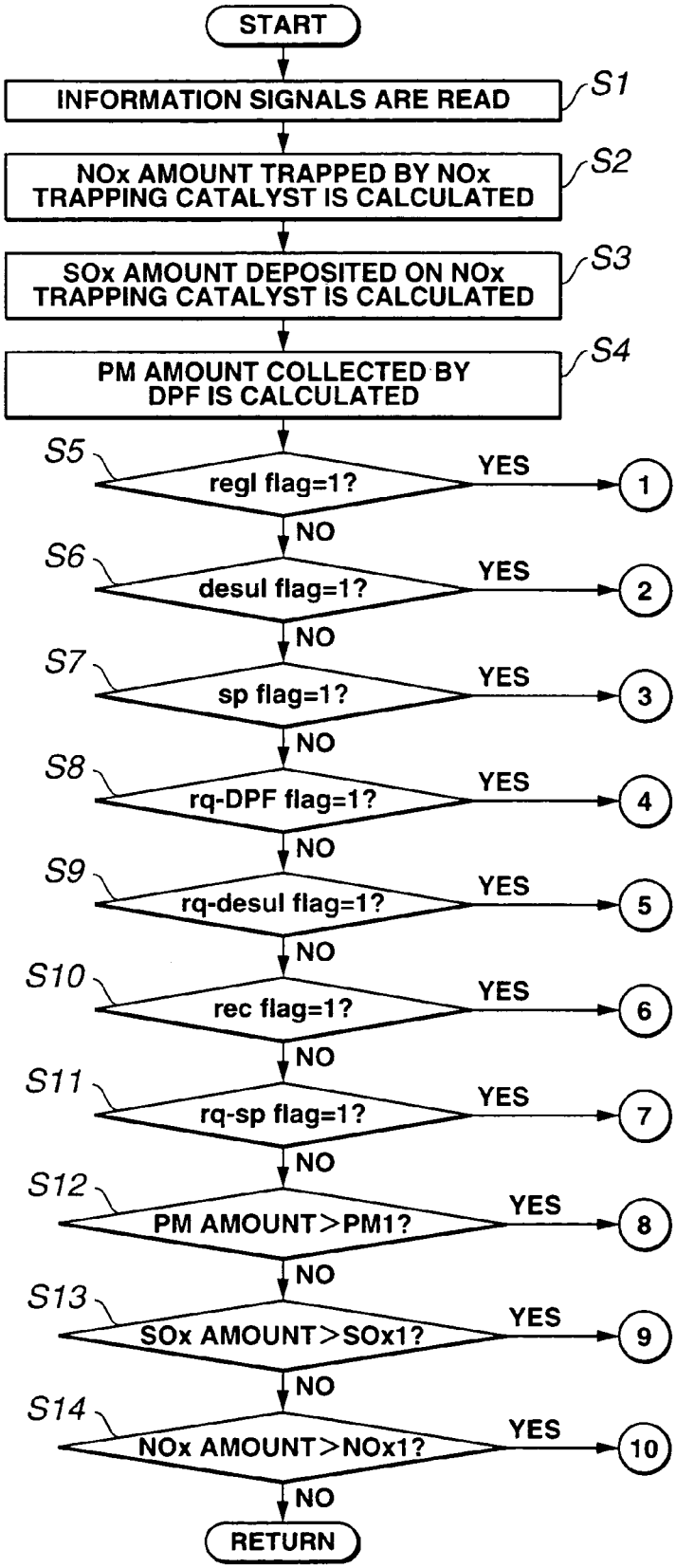
FIG. 2 is a flowchart showing programmed operation steps of a main routine executed by a control unit employed in the present invention.

FIG. 2 is a flowchart that shows programmed operation steps of a main routine executed by control unit 20.

At step S1, information signals from the various sensors 21, 22, 23, 24, 25 and 26 are read. That is, the information signals on the engine speed Ne, the accelerator depression degree APO, the NOx catalyst temperature, the exhaust pressure exerted between NOx trapping catalytic converter 13 and diesel particulate filter 14, the temperature of diesel particulate filter 14 and the exhaust-λ at the outlet of diesel particulate filter 14 are read. Furthermore, at this step S1, a fuel injection quantity "Q" at the main fuel injection is looked up from a map that uses the engine speed Ne and the accelerator depression degree APO as parameters. If desired, the temperature of diesel particulate filter (DPF) 14 may be estimated from the temperature of exhaust gas flowing in exhaust passage 10.

At step S2, an amount of NOx trapped by NOx trapping catalytic converter 13 is calculated. The method of this calculation is described in for example WO93/07363. That is, the amount of NOx trapped may be estimated from an integrated value of engine speed or from a travel distance of an associated motor vehicle. If the estimation is made based on the integrated value of engine speed, the integrated value should be reset to zero upon completion of NOx-regeneration and/or upon completion of NOx-regeneration that has been simultaneously carried out with SOx-regeneration.

At step S3, an amount of SOx deposited on the NOx trapping catalyst (13) is calculated. Like in case of calculation of the amount of NOx, the amount of SOx may be estimated from the integrated value of engine speed or from the travel distance of the associated motor vehicle. If the estimation is made based on the integrated value of engine speed, the integrated value should be reset to zero upon completion of NOx-regeneration.

At step S4, an amount of the particulate matter (PM) collected by and deposited on diesel particulate filter 14 is calculated. With increase of amount of the deposited particulate matter (PM), the exhaust pressure exerted in the inlet part of the filter 14 increases. Thus, by comparing the existing exhaust pressure at the inlet part of the filter 14 actually detected by exhaust pressure sensor 24 with a reference exhaust pressure that is provided based on the existing operation condition of the engine (that is represented by the engine speed Ne and fuel injection quantity Q), the amount of deposited particulate matter (PM) can be estimated. If desired, by combining the integrated value of engine speed or travel distance that is provided upon completion of a previous DPF-regeneration with the exhaust pressure, the amount of deposited particulate matter (PM) may be estimated.

At step S5, judgment is carried out as to whether "regl flag" representing that the control system is under DPF-regeneration mode (namely, the diesel particulate filter (DPF) 14 is under regeneration mode) is raised or not. If "regl flag=1" is established, the operation flow goes to the flowchart of FIG. 3 for actually carrying out DPF-regeneration, which will be described hereinafter.

At step S6, judgment is carried out as to whether "desul flag" representing that the control system is under SOx-regeneration mode (namely, the NOx trapping catalyst (13) is under a SOx-poisoning releasing mode) is raised or not. If "desul flag=1" is established, the operation flow goes to the flowchart of FIG. 4 for carrying out SOx-regeneration, which will be described hereinafter.

At step S7, judgment is carried out as to whether "sp flag" representing that the control system is under NOx-regeneration mode (namely, rich-spike mode for releasing the trapped NOx from NOx trapping catalyst (13)) is raised or not. If "sp flag=1" is established, the operation flow goes to the flowchart of FIG. 5 for actually carrying out NOx-regeneration, which will be described hereinafter.

At step S8, judgment is carried out as to whether "rq-DPF flag" representing that the control system needs DPF-regeneration is raised or not. If "rq-DPF=1" is established, that is, when the diesel particulate filter (DPF) needs the regeneration, the operation flow goes to the flowchart of FIG. 6 for deciding a process precedence under the need of DPF-regeneration, which will be described hereinafter.

At step S9, judgment is carried out as to whether "rq-desul flag" representing that the control system needs NOx-regeneration is raised or not. If "rq-desul flag=1" is established, that is, when the NOx-trapping catalyst (13) needs a releasing of SOx therefrom, the operation flow goes to the flowchart of FIG. 7 for deciding a process precedence under the need of SOx releasing, which will be described hereinafter.

At step S10, judgment is carried out as to whether "rec flag" representing that the control system is under a durability lowering suppression mode after SOx-regeneration or NOx-regeneration is raised or not. If "rec flag=1" is established, that is, when the control system is under the durability lowering suppressing mode, the operation flow goes to the flowchart of FIG. 8 for carrying out a control for suppressing lowering of the durability of the diesel particulate filter (DPF) 14, which will be described hereinafter.

Figure 9:
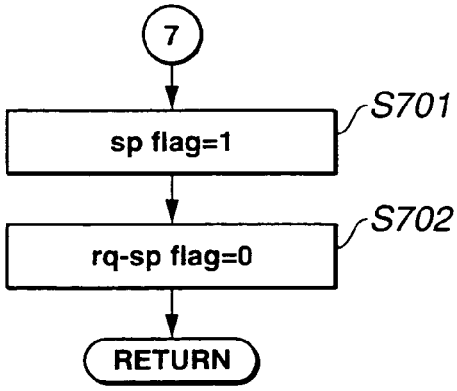
FIGS. 9 to 12 are flowcharts each showing programmed operation steps executed by the control unit for setting a flag.

At step S11, judgment is carried out as to whether "rq-sp flag" representing that the control system needs NOx-regeneration is raised or not. If "rq-sp flag=1" is established, that is, when the control system needs NOx-regeneration, the operation flow goes to the flowchart of FIG. 9. As is shown in the flowchart of FIG. 9, at step S701, "sp flag=1" is made for starting NOx-regeneration and at step S702, "rq-sp flag=0" is made.

Figure 13:
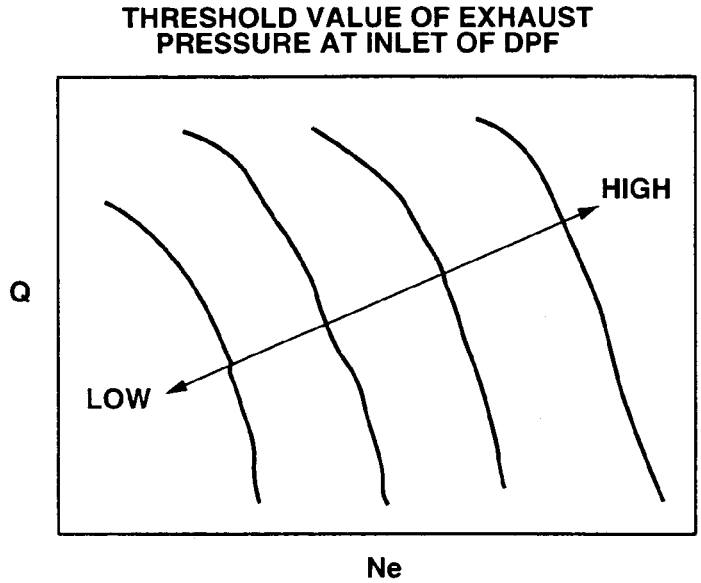
FIG. 13 is a map showing a threshold value of an exhaust pressure exerted at an inlet part of the diesel particulate filter (DPF)

Referring back to the flowchart of FIG. 2, at step S12, judgment is carried out as to whether the amount of the deposited particulate matter (PM) calculated at step S4 has reached a predetermined amount PM1 or not, that is, whether it is the time for effecting DPF-regeneration or not. If desired, the following measure may be employed for such judgment. That is, by checking the exhaust pressure at the inlet portion of the diesel particulate filter (DPF) 14 at the time when the amount of the particulate matter (PM) collected by and deposited on the filter (DPF) 14 shows the predetermined amount PM1 for each engine operation condition (that is represented Ne and Q), such a data map as shown in FIG. 13 is provided by using the data. And, when an exhaust pressure detected by exhaust pressure sensor 24 reaches a threshold value of the map under the existing operation condition (Ne and Q) of the engine, it may be decided that the time for carrying out DPF-regeneration has come.

Figure 10:
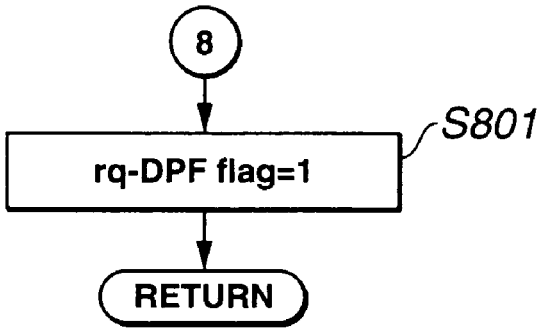
Figure 11:
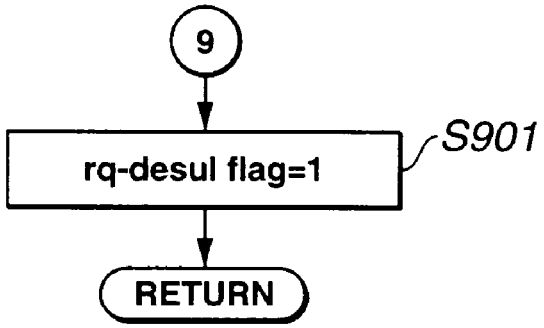
Figure 12:
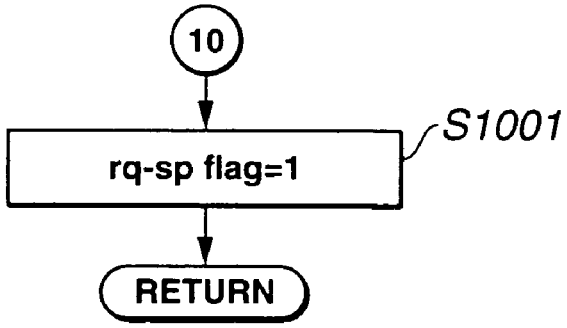

If the amount of PM is judged larger than the predetermined amount PM1, that is, when it is judged that the time for carrying out DPF-regeneration has come, the operation flow goes to the flowchart of FIG. 10. As shown by this flowchart, at step S801, "rq-DPF flag=1" is made for issuing the need of DPF-regeneration.

Referring back to the flowchart of FIG. 2, at step S13, judgment is carried out as to whether the amount of SOx calculated at step S3 has reached a predetermined amount SOx1 or not, that is, whether it is the time for effecting SOx-regeneration or not. When it is judged that the amount of SOx is larger than the predetermined amount SOx1, that is, when it is judged that it is the time for carrying out SOx-regeneration, the operation flow goes to the flowchart of FIG. 11. As shown in this flowchart, at step S901, "re-desul flag=1" is made for issuing the need of SOx-regeneration (viz., the need of releasing SOx poisoning from NOx trapping catalyst (13)).

At step S14, judgment is carried out as to whether the amount of the trapped NOx calculated at step S2 has reached a predetermined amount NOx1 or not, that is, whether it is the time for carrying out NOx-regeneration or not. When it is judged that the amount of the trapped NOx is larger than the predetermined amount NOx1, that is, when it is judged that it is the time for carrying out NOx-regeneration, the operation flow goes to the flowchart of FIG. 12. As is seen from this flowchart, at step S1001, "rq-sp flag=1" is made for issuing the need of NOx-regeneration.

Figure 3:
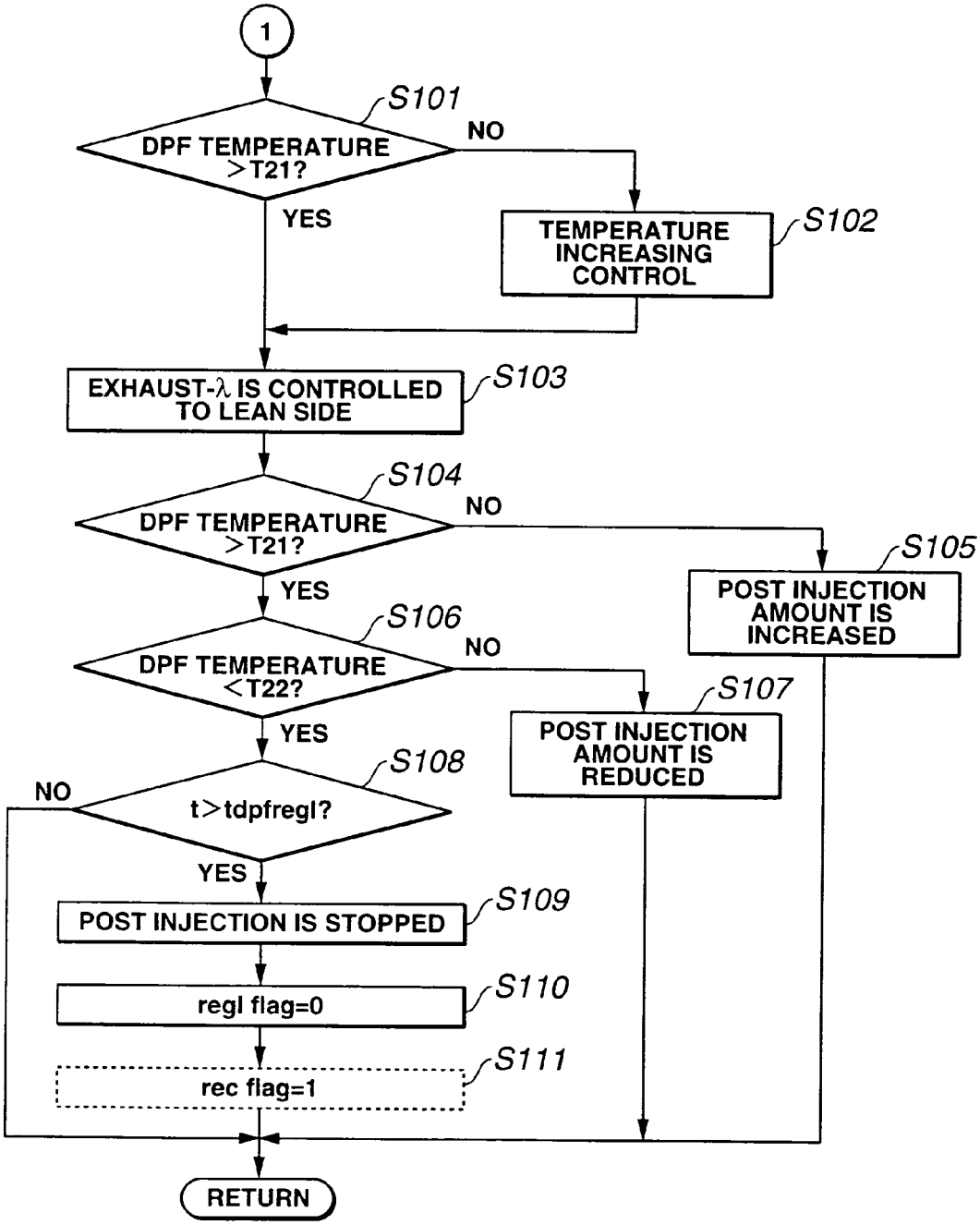
FIG. 3 is a flowchart showing programmed operation steps executed by the control unit for controlling regeneration of a diesel particulate filter (DPF)

Referring to FIG. 3, there is shown the flowchart for the DPF-regeneration mode. As will become apparent as the description proceeds, when, due to reaching of the amount of particulate matter (PM) to the predetermined amount PM1, "rq-DPF flag=1" becomes established and when thereafter "regl flag=1" is made in the flowchart of FIG. 6, the process for the DPF-regeneration mode starts.

In the flowchart of FIG. 3, at step S101, judgment is carried out as to whether or not the temperature of diesel particulate filter (DPF) has exceeded a predetermined temperature T21 that is needed for burning the particulate matter (PM). If NO, that is, when the DPF temperature is lower than the predetermined temperature T21, the operation flow goes to step S102. At this step S102, a temperature increasing control is carried out by throttling the throttle valve 5 until the time when the DPF temperature reaches the predetermined temperature T21. Upon reaching the predetermined temperature T21, the operation flow goes to step S103. If YES at step S101, that is when the DPF temperature is higher than the predetermined temperature T21, the operation flow directly goes to step S103.

Figure 14:
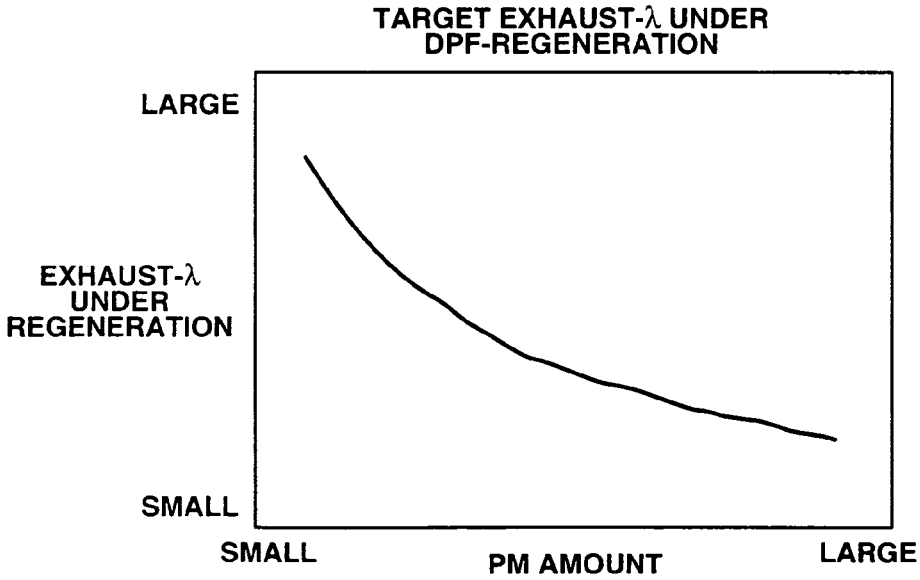
FIG. 14 is a table showing a needed λ (viz., target exhaust-λ) during regeneration of the diesel particulate filter (DPF)
Figure 15:
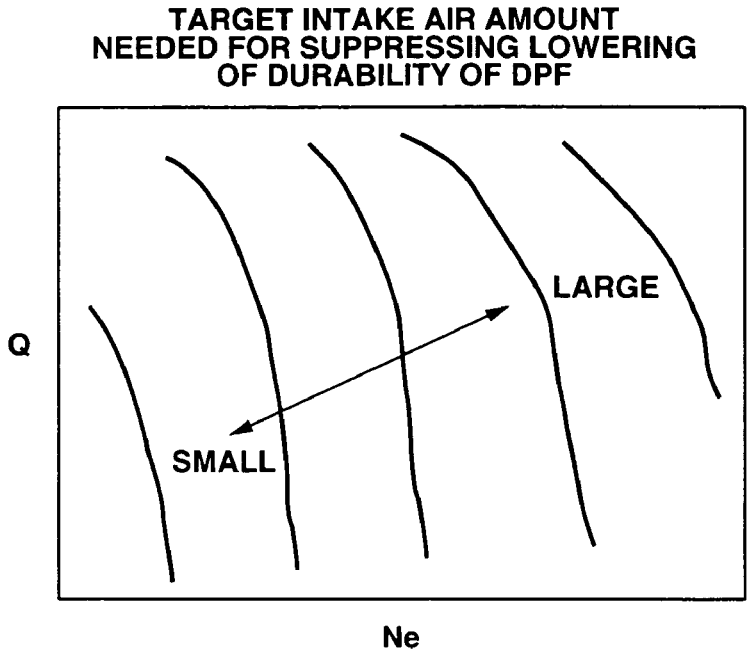
FIG. 15 is a map showing a target intake air amount needed for suppressing lowering of the durability of the diesel particulate filter (DPF)

At step S103, the exhaust-λ is controlled at a leaner side for carrying out the DPF-regeneration. That is, a target exhaust-λ is set in accordance with an estimated amount of PM collected by diesel particulate filter (DPF) 14 with reference to a map of FIG. 14. The target exhaust-λ is set small (viz., richer side in air/fuel ratio) as the amount of particulate matter (PM) increases. This is because, under DPF-regeneration, the burning propagation of the particulate matter (PM) becomes marked with increase of the amount the particulate matter (PM) and thus, the durability of the diesel particulate filter (DPF) 14 tends to lower. Control of the exhaust-λ is carried out by controlling throttle valve 5 (and/or EGR valve 12). Basically, the control is carried out so as to obtain a target intake air amount that is depicted by a map of FIG. 16. If the exhaust-λ is largely different from the target value, further control or adjustment is carried out for bringing the exhaust-λ to the target value.

Referring back to the flowchart of FIG. 3, at step S104, judgment is carried out as to whether DPF temperature has exceeded a predetermined temperature T21 (viz., target lowest temperature) or not. This because by the control of the exhaust-λ at step S103, there is induced such a possibility that the DPF temperature becomes lower than the predetermined temperature T21. When DPF temperature is lower than the predetermined temperature T21, the operation flow goes to step S105, while, when DPF temperature is higher than the predetermined temperature T21, the operation flow goes to step S106.

Figure 16:
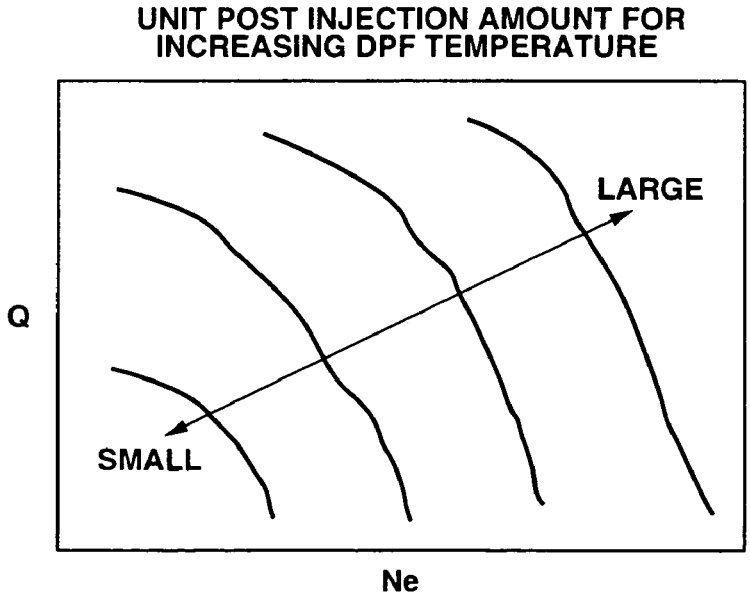
FIG. 16 is a map showing a unit post injection quantity for increasing the temperature of the diesel particulate filter (DPF)

At step S105, a post injection is carried out based on an operation condition (Ne, Q) depicted by a map of FIG. 16. That is, post injection amount "postQ" is increased.

At step S106, judgment is carried out as to whether DPF temperature is lower than a predetermined temperature T22 that is needed during regeneration of the diesel particulate filter (DPF) 14 or not. If NO, that is, when DPF temperature is higher than the predetermined temperature T22, the operation flow goes to step S107, while, if YES, that is, when DPF temperature is lower than the predetermined temperature T22, the operation flow goes to step S108.

At step S107, the post injection is stopped or the post injection amount "postQ" is reduced. This step is for suppressing excessive temperature increase of the diesel particulate filter (DPF) 14 due to burning of the particulate matter (PM). The excessive temperature increase brings about lowering of the durability of the diesel particulate filter (DPF) 14.

Due to fluctuation of the post injection amount, the exhaust-λ is varied. However, at step S103 that will follow, the air intake amount is controlled or adjusted again, and thus a target exhaust-λ and a target DPF temperature are both realized.

At step S108, judgment is carried out as to whether a predetermined time "tdpfregl" has passed in the DPF-regeneration mode (that is, under the mode wherein the target exhaust-λ and target DPF temperature are kept) or not. If YES, that is, when the predetermined time has passed, the operation flow goes to step S109 estimating that the particulate matter (PM) collected by the diesel particulate filter (DPF) 14 has been fully burnt (viz., completion of the DPF-regeneration).

At step S109, the post injection is stopped because of completion of the DPF-regeneration. With this, heating of the diesel particulate filter (DPF) 14 is stopped.

At step S110, "regl flag=0" is made.

If desired, by adding step S111 after step S110, "rec flag=1" may be made for preparation to enter an after-mentioned durability lowering suppression mode. That is, even when the DPF-regeneration has been completed, there is such a possibility that if the exhaust-λ is suddenly set to a larger value with a certain amount of cinder of the particulate matter (PM) left in the diesel particulate filter (DPF) 14, the cinder is instantly burnt, which would cause lowering of the durability of the diesel particulate filter (DPF) 14.

Figure 4:
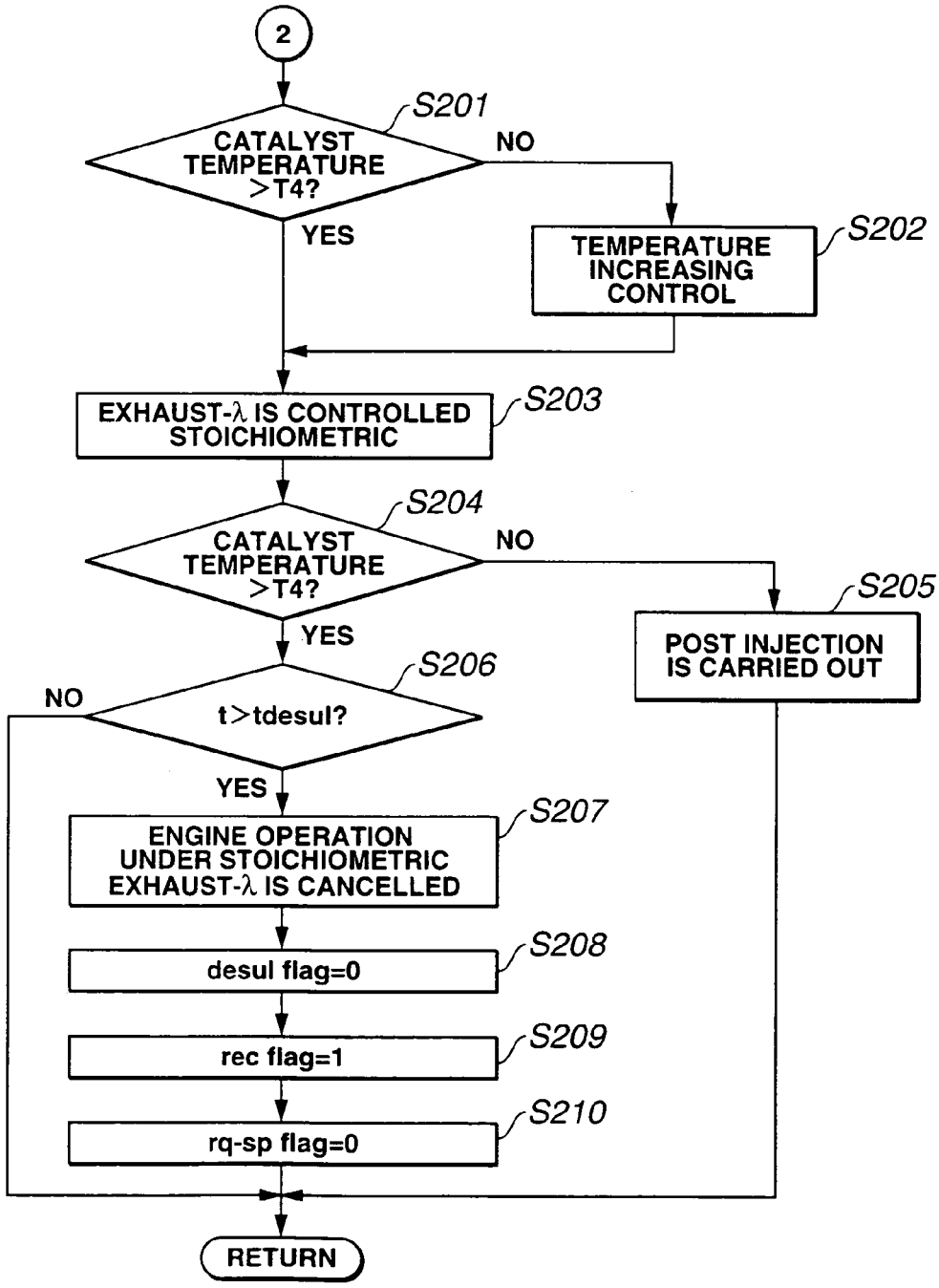
FIG. 4 is a flowchart showing programmed operation steps executed by the control unit for purifying SOx deposited on the catalyst of a NOx trapping catalytic converter.

Referring to FIG. 4, there is shown the flowchart for the SOx-regeneration mode. When, due to reaching of the amount of SOx to the predetermined amount SOx1, "rq-desul flag=1" becomes established and when thereafter "desul flag=1" is established in the flowchart of FIG. 7, the flow for the SOx-regeneration mode starts.

In the flowchart of FIG. 4, at step S201, judgment is carried out as to whether or not the catalyst temperature of NOx trapping catalytic converter 13 (viz., the temperature of the carrier of the catalyst) has exceeded a predetermined temperature T4 that is needed for the SOx-regeneration. If NO, that is, when the catalyst temperature is lower than the predetermined temperature T4, the operation flow goes to step S202, while, if YES, that is, when the catalyst temperature is higher than the predetermined temperature T4, the operation flow goes to step S203. It is to be noted that for carrying out the SOx-regeneration, a stoichiometric or richer value for the exhaust-λ and a temperature higher than the predetermined temperature T4 are needed. That is, if the NOx trapping catalyst (13) contains, for example, a vanadium catalyst, the SOx-regeneration needs a higher than 600° C. under a stoichiometric or richer atmosphere in the exhaust-λ. Thus, the predetermined temperature T4 is set to a higher than 600° C.

At step S202, a temperature increasing control is carried out by throttling the throttle valve 5 until the time when the catalyst temperature reaches the predetermined temperature T4. Upon reaching the predetermined temperature T4, the operation flow goes to step S203.

Figure 17:
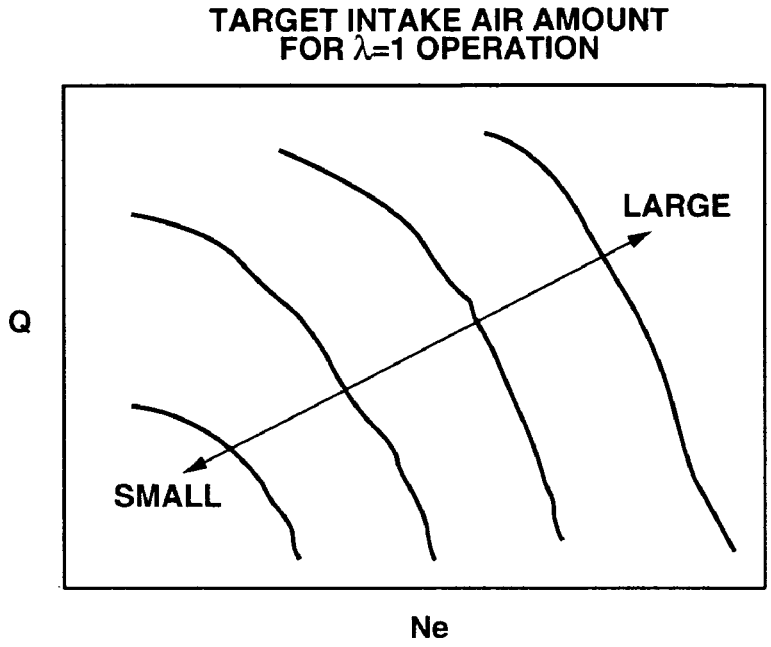
FIG. 17 is a map showing a target intake air amount needed for carrying out a stoichiometric operation of the engine.

At step S203, the exhaust-λ is controlled at a stoichiometric ratio for carrying out the SOx-regeneration. That is, this control is carried out by controlling throttle valve 5 (and/or EGR valve 12). Basically, the control is carried out so as to obtain a target intake air amount for the stoichiometric exhaust-λ that is depicted by a map of FIG. 17. If the exhaust-λ is largely different from the stoichiometric value, further control or adjustment is carried out for bringing the exhaust-λ to the stoichiometric value.

Referring back to the flowchart of FIG. 4, at step S204, judgment is carried out as to whether the catalyst temperature has exceeded the predetermined temperature T4 or not. This is because by the control of the exhaust-λ at step S203, there is induced such a possibility that the catalyst temperature becomes lower than the predetermined temperature T4. When the catalyst temperature is lower than the predetermined temperature T4, the operation flow goes to step S205, while, when the catalyst temperature is higher than the predetermined temperature T4, the operation flow goes to step S206.

At step S205, for increasing the catalyst temperature, a predetermined post injection is carried out based on an operation condition depicted by the map of FIG. 16. The exhaust-λ is varied due to the post injection. However, at step S203 that will follow, the intake air amount is controlled or adjusted again, then thus, a target exhaust-λ and a target catalyst temperature are both realized.

At step 206, judgment is carried out as to whether a predetermined time "tdesul" has passed in the SOx-regeneration mode (that is, under the mode wherein the target exhaust-λ and target catalyst temperature) or not. If YES, that is, when the predetermined time has passed, the operation flow goes to step S207 estimating that the SOx-regeneration has been completed.

At step S207, the engine operation under the stoichiometric exhaust-λ is cancelled.

At step S208, "desul flag=0" is made because of completion of the SOx-regeneration.

At step S209, "rec flag=1" is made for preparation to enter the durability lowering suppressing mode. That is, even when the SOx-regeneration has been completed, the continuation of the engine operation under the stoichiometric exhaust-λ keeps the high temperature of the exhaust gas. Thus, if, under such high temperature condition, the exhaust-λ is suddenly set to a larger value with a certain amount of the deposited particulate matter (PM) left in the diesel particulate filter (DPF) 14, the particulate matter (PM) is instantly burnt in the diesel particulate filter 14, which would cause lowering of the durability of the diesel particulate filter (DPF) 14.

At step S210, "rq-sp flag=0" is made. During the SOx-regeneration, the NOx trapping catalyst (13) is exposed to the exhaust gas of stoichiometric air/fuel ratio for a longer time, and thus, the NOx-regeneration is also carried out at the same time. Accordingly, the step S210 is for stopping the NOx-regeneration when the need of the same is issued.

Figure 5:
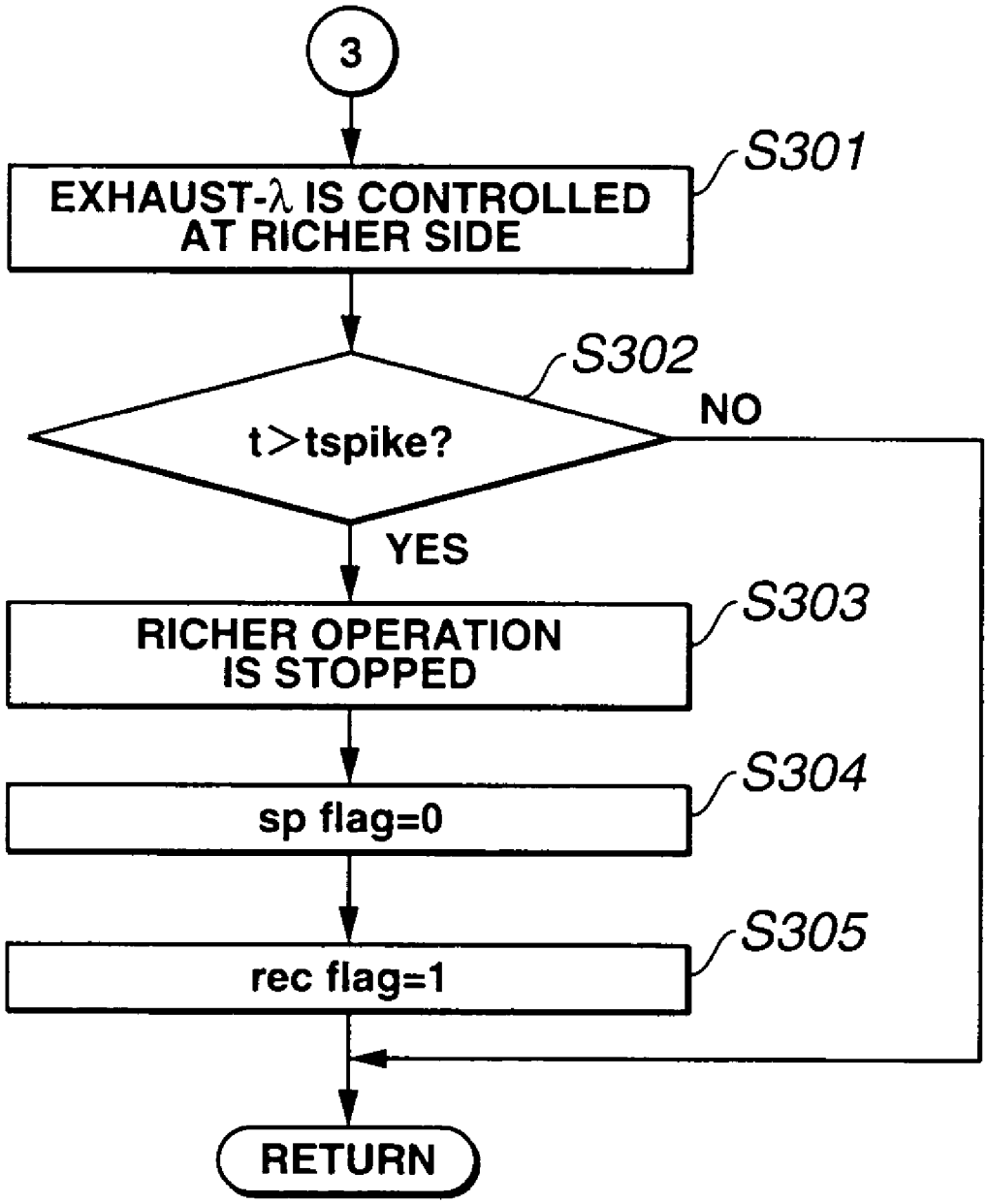
FIG. 5 is a flowchart showing programmed operation steps executed by the control unit for releasing NOx from the catalyst of the NOx trapping catalytic converter.

Referring to FIG. 5, there is shown the flowchart for the NOx-regeneration mode. When, due to reaching of the amount of NOx to the predetermined amount NOx1, "rq-sp flag=1" becomes established and when thereafter "sp flag=1" is established in the flowchart of FIG. 6, 7 or 9, the flow for the NOx-regeneration mode starts.

Figure 18:
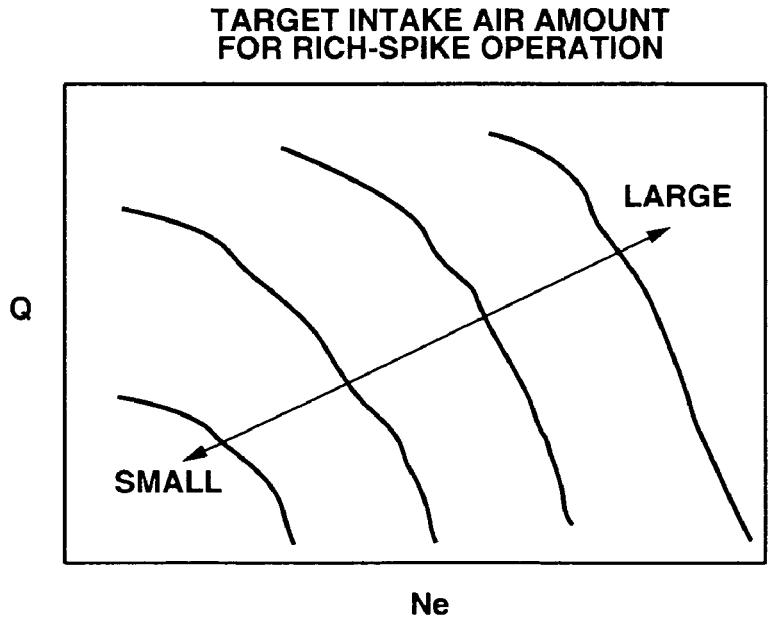
FIG. 18 is a map showing a target intake air amount needed for carrying out a rich-spike operation.

In the flowchart of FIG. 5, at step S301, the exhaust-λ is controlled at a richer side for carrying out the NOx-regeneration. That is, basically, by controlling throttle valve 5 and/or EGR valve 12, the control is carried out as to obtain a target intake air amount for a rich-spike operation as depicted by a map of FIG. 18. If the exhaust-λ is largely different from the target value, further control or adjustment is carried out for bringing the exhaust-λ to the target value.

Referring back to the flowchart of FIG. 5, at step S302, judgment is carried out as to whether a predetermined time "tspike" has passed in the NOx-regeneration mode (viz., under richer exhaust-λ or not. If YES, that is, when the predetermined time has passed, the operation flow goes to step S303 estimating that the NOx-regeneration has been completed.

It is to be noted that the predetermined time "tspike" is smaller than the above-mentioned predetermined time "tdesul" (see step S206 of FIG. 4). That is, "tspike"<"tdesul" is established.

At step S303, the richer operation (viz., operation under the richer exhaust-λ is stopped because the NOx-regeneration has been completed.

At step S304, for the same reason, "sp flag=0" is made.

Then, at step S305, "rec flag=1" is made for preparation to enter the durability lowering suppression mode. That is, even when the NOx-regeneration has been completed, continuation of the richer operation causes a higher temperature of the NOx trapping catalyst (13) like in case of the above-mentioned SOx-regeneration. If, under this condition with a certain amount of the deposited particulate matter (PM) left in the diesel particulate filter (DFP) 14, the exhaust-λ is suddenly set to a larger value, the particulate matter (PM) is instantly burnt in the diesel particulate filter (DPF) 14, which would cause lowering of the durability of the diesel particulate filter (DPF) 14.

Figure 6:
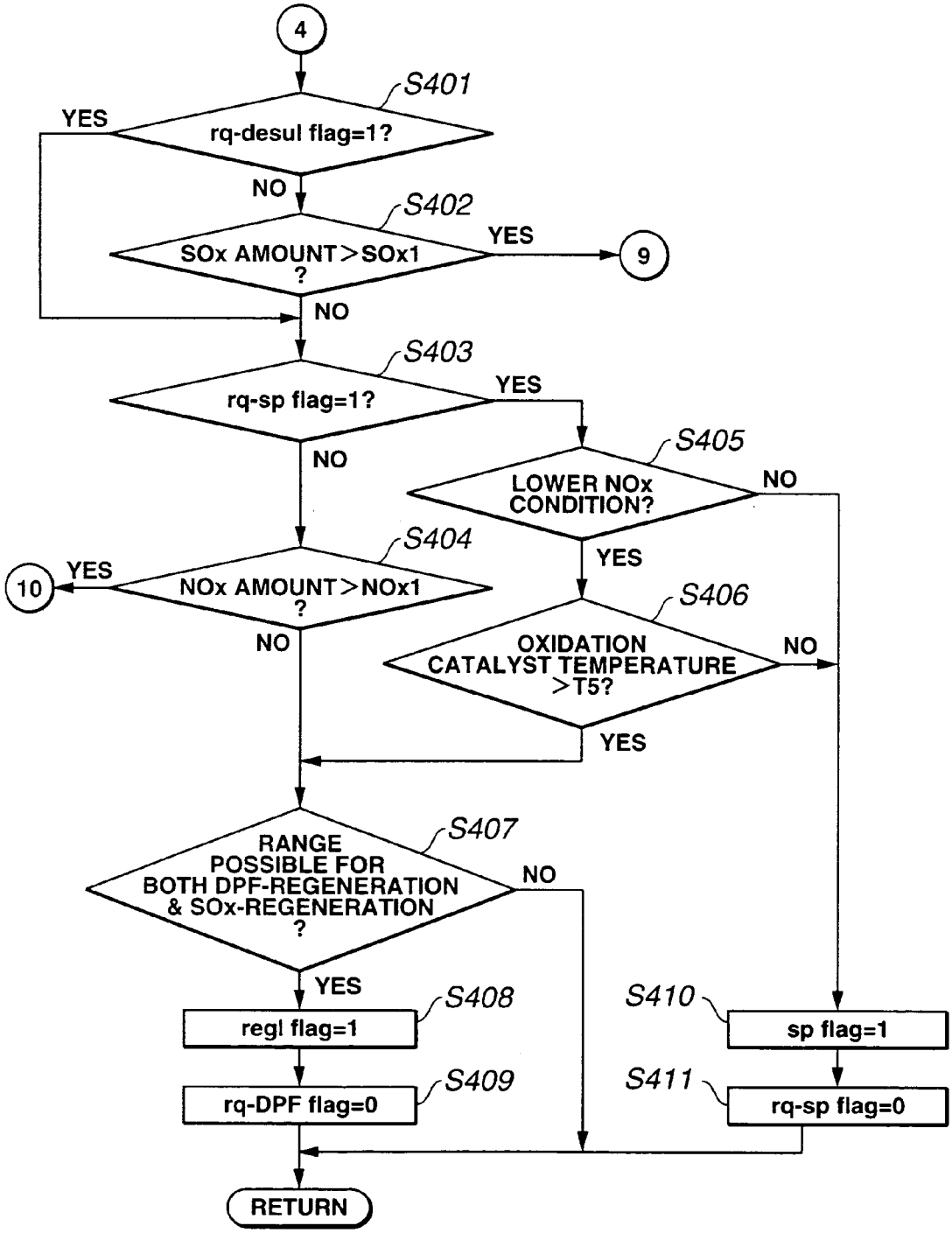
FIG. 6 is a flowchart showing programmed operation steps executed by the control unit for deciding a process precedence under mode I.

Referring to FIG. 6, there is shown the flowchart for deciding a process precedence under mode I. This flowchart is used when the need of DPF-regeneration and at least one of the need of NOx-regeneration and that of SOx-regeneration take place at the same time, for deciding the precedence of the needs.

As is seen from the flowchart of FIG. 2, once the need of DPF-regeneration (viz., rq-DPF flag=1) takes place, the operation steps of the flowchart are forced to start.

At step S401 in the flowchart of FIG. 6, judgment is carried out as to whether there is a need of SOx-regeneration (viz., rq-desul flag=1") or not. If YES, that is, when there is such a need, the operation goes to S403, and while if NO, that is, when there is not such a need, the operation flow goes to step S402.

At step S402, like in the above-mentioned step S13 of FIG. 2, judgment is carried out as to whether the amount of SOx calculated has reached the predetermined amount SOx1 or not, that is, whether it is the time for carrying out the SOx-regeneration or not. If YES, that is, when the amount has reached the predetermined amount SOx1, the operation flow goes to an after-mentioned step S901 of FIG. 11. While, if NO, that is, when the amount has not reached the predetermined amount SOX1 yet, the operation flow goes to step S403.

At step S403, judgment is carried out as to whether there is a need of NOx-regeneration (viz., rq-sp flag=1) or not. If YES, that is, when such need is present, the operation flow goes to step S405, while, if NO, that is, when there is not such request, the operation flow goes to step S404.

At step S404, like in the above-mentioned step S14 of FIG. 2, judgment is carried out as to whether the amount of trapped NOx calculated has reached the predetermined amount NOx1 or not, that is, whether it is tie time for carrying out the NOx-regeneration or not. If YES, that is, when it is the time, the operation flow goes to the above-mentioned step S1001 of FIG. 12, and if NO, that is, when it is not the time, the operation flow goes to step S407. That is, under this case, the need of DPF-regeneration is present but the need of NOx-regeneration is not present, and thus, the operation flow goes to step S407 for giving a priority to DPF-regeneration.

While, at step S405, judgment is carried out as to whether or not the engine operation condition is a lower NOx condition wherein the amount of NOx emitted from the engine 1 is small (viz., normal operation condition).

If YES, that is, when the condition is the lower NOx condition, the operation flow goes to step S406. Under this condition, it is preferable to carry out the DPF-regeneration, that affects the drivability of the engine 1, at first, because deterioration of the exhaust gas discharged to the open air from the tail pipe is not recognized even if the regeneration of the NOx trapping catalyst (13) is somewhat delayed.

While, if NO at step S405, that is, when the condition is not the lower NOx condition, the operation flow goes to step S410. That is, when the engine 1 is under for example an acceleration, NOx-regeneration should be carried out at first for suppressing deterioration of the exhaust gas discharged to the open air from the tail pipe.

At step S406, judgment is carried out as to whether or not the temperature of the diesel particulate filter (DPF) 14 is hither than a predetermined temperature T5 that activates the oxidation catalyst carried by the filter (DPF) 14.

If YES, that is, when the filter temperature is higher than the predetermined temperature T5, the operation flow goes to step S407 for giving a priority to DPF-regeneration.

While, if NO, that is, when the filter temperature is lower than the predetermined temperature T5, the operation flow goes to step S410 for giving a priority to NOx-regeneration. That is, under this condition, even when the temperature increasing control is carried out by throttling the throttle valve 5, sufficient heat of combustion is not obtained and thus reaching the temperature for DPF-regeneration takes a longer time. Furthermore, under such condition, the amount of NOx emitted to the open air from the tail pipe during the temperature increasing process is marked, and thus it is preferable to carry out the NOx-regeneration at first.

Figure 20:
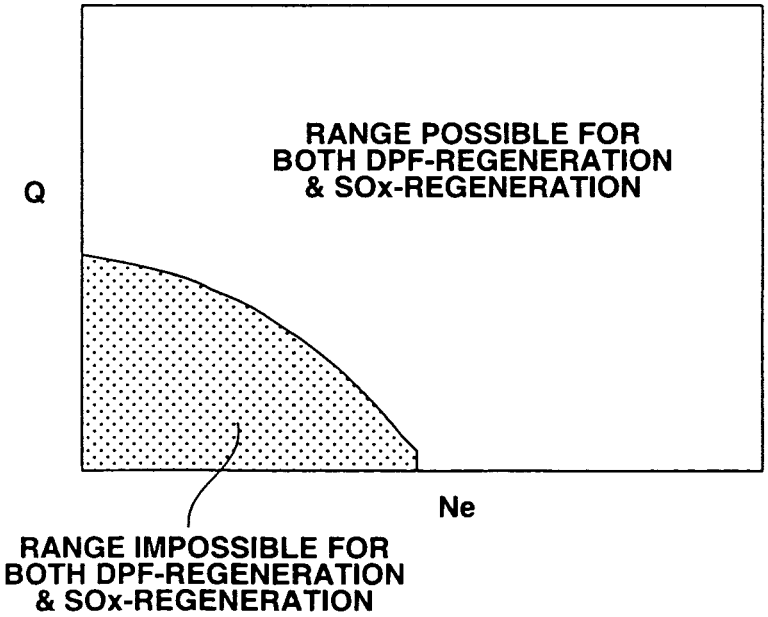
FIG. 20 is a map showing a range where both regeneration of the diesel particulate filter (DPF) and regeneration of SOx are possible.

At step S407, since DPF-regeneration has the priority, judgment is carried out as to whether or not the current operation condition (viz., condition represented by Ne and Q) is within a predetermined range where both DPF-regeneration and SOx-regeneration are possible with reference to a map of FIG. 20. If YES, that is, the current operation condition is within the predetermined range, the operation flow goes to step S408.

At step S408, "regl flag=1" is established for preparation of starting DPF-regeneration at first. Then, at step S409, "rq-DPF flag=0" is made because "regl flag=1" has been established at step S408.

At step S410, because NOx-regeneration has the priority, "sp flag=1" is established for preparation of starting NOx-regeneration at first. Then, at step S411, "rq-sp flag=0" is made because "sp flag=1" has been established at step S410.

In the following, the map of FIG. 20 will be described in detail.

In order to carry out DPF-regeneration (or SOx-regeneration), it is necessary that the temperature of the diesel particulate filter (DPF) 14 (or the temperature of the NOx trapping catalyst (13)) is higher than a predetermined temperature. Since, usually, the exhaust temperature of the diesel engine is lower than the predetermined temperature, for carrying out such regeneration, it is necessary to increase the temperature of the diesel particulate filter (DPF) 14 (or the temperature of the NOx-trapping catalyst (13)) to a temperature higher than the predetermined temperature.

The exhaust temperature and the exhaust-λ have a correlation, and the exhaust temperature increases as the exhaust-λ decreases. Thus, for increasing the exhaust temperature, it is necessary to make the exhaust-λ smaller. However, if the exhaust-λ is made smaller, HC and CO in the exhaust gas tend to show a marked deterioration (or amount), and the deterioration rate of HC and CO becomes as the exhaust-λ is made small, that is, the deterioration rate of HC and CO becomes marked with increase of the rate of temperature increase that is needed at the regeneration. Like this, the temperature increase performance and the exhaust performance have a so-called trade-off relationship.

That is, in the map of FIG. 20, the clear range (viz., range possible for both DPF-regeneration and SOx-regeneration) is a range that shows data that have been previously set by carrying out experiments in such a manner that the exhaust performance under the temperature increase does not exceed a tolerance value. In other words, if the engine operation condition is within the shadow range (viz., range impossible for both DPF-regeneration and SOx-regeneration), the temperature increase causes that the deterioration rate of the exhaust performance exceeds the tolerance value because of the marked temperature increase rate. Accordingly, the regeneration is not carried out in such shadow range.

Figure 7:
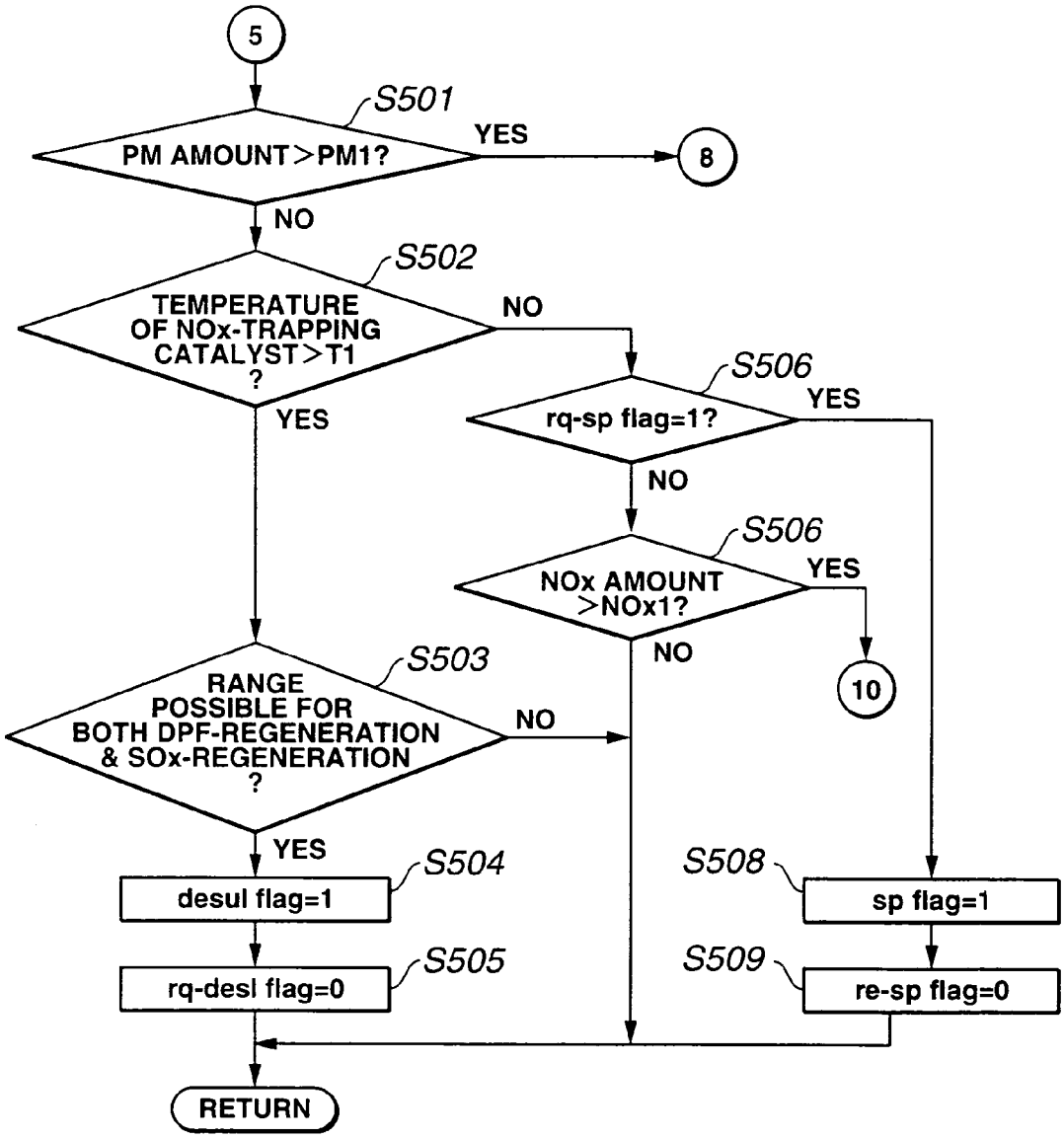
FIG. 7 is a flowchart showing programmed operation steps executed by the control unit for deciding a process precedence under mode II.

Referring to FIG. 7, there is shown the flowchart for deciding a process precedence under mode II. This flowchart is used when the need of SOx-regeneration and that of NOx-regeneration take place at the same time, for deciding the precedence of the needs.

As is seen from the flowchart of FIG. 2, once the need of SOx-regeneration (viz., rq-desul flag=1) takes place, the operation steps of the flowchart are forced to start.

At step S501, before carrying out the SOx-regeneration practically, judgment is carried out as to whether the amount of particulate matter (PM) of the diesel particulate filter (DPF) 14 has reached the predetermined amount PM1 or not, that is, whether it is the time for starting DPF-regeneration or not. If YES, that is, when it is the time, the operation flow goes to step S801 of FIG. 10. In this case, finally, DPF-regeneration has a priority using the operation steps of the flowchart of FIG. 6 If NO at step S501, that is, when it is not the time, the operation flow goes to step S502.

At step S502, judgment is carried out as to whether or not the temperature of the NOx trapping catalyst (13) is higher than a predetermined temperature T1 (for example, temperature that activates the catalyst (13)) that is suitable for the SOx-regeneration.

It is to be noted that the activation temperature T1 of the NOx trapping catalyst (13) is lower than the activation temperature T5 of the oxidation catalyst carried by the diesel particulate filter (DPF) 14.

If YES at step S502, that is, when the temperature of the NOx trapping catalyst (13) is higher than the predetermined temperature T1, the operation flow goes to step S503 for preceding the NOx-regeneration.

While, if NO at step S502, that is, when the temperature is lower than the predetermined temperature T1, the operation flow goes to step S506. That is, under this condition, even when the temperature increasing control is carried out by throttling the throttle valve 5, sufficient heat of combustion is not obtained and thus, reaching the temperature for the regeneration takes a longer time. Furthermore, under such condition, the amount of NOx emitted to the open air from the tail pipe during such temperature increasing process is marked, and thus, it is preferable to precede NOx-regeneration if there is the need of the NOx-regeneration. Thus, the operation flow goes to step S506.

At step S503, since the SOx-regeneration has the priority, judgment is carried out as to whether or not the current engine operation condition (viz., condition represented by Ne and Q) is within the clear range where both DPF-regeneration and SOx-regeneration are possible with reference to the map of FIG. 20. If YES, that is, when the engine operation condition is within the clear range, the operation flow goes to step S504.

At step S504, "desul flag=1" is made for preparation of starting the SOx-regeneration. Then, at step S505, "rq-desul flag=0" is made because "desul flag=1" has been made at step S504.

While, at step S506, judgment is carried out as to whether there is a need of the NOx-regeneration, that is, whether "rq-sp flag=1" is present or not. If YES, that is, when such need is present, the operation flow goes to step S508 for preceding the NOx-regeneration. While, if NO, that is, when such need is not present, the operation flow goes to step S507. At this step, like at the above-mentioned step S14, judgment is carried out as to whether the amount of the trapped NOx calculated has reached the predetermined amount NOx1 or not, that is, whether it is the time for carrying out the NOx-regeneration or not. If YES, that is, when it is the time, the operation flow goes to step S1001 of FIG. 12.

At step S508, since the NOx-regeneration has the priority, "sp flag=1" is made for preparation of starting the NOx-regeneration. Then, at step S509, "rq-sp flag=0" is made since "sp flag=1" has been made at step S508.

Figure 8:
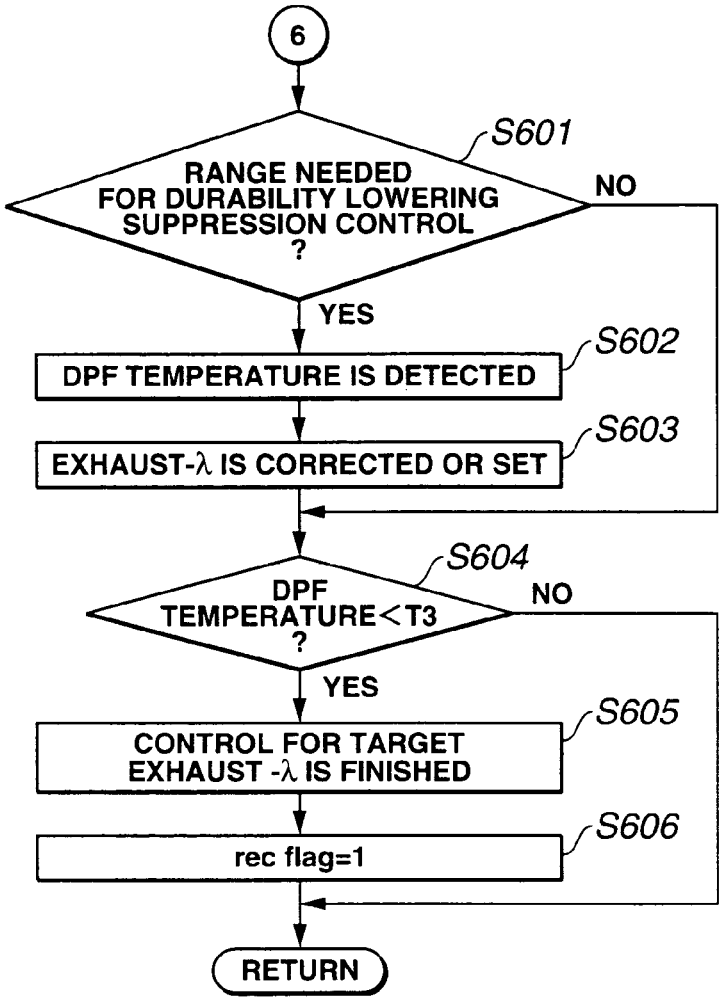
FIG. 8 is a flowchart showing programmed operation steps executed by the control unit for suppressing lowering of the durability of the diesel particulate filter (DPF)

Referring to FIG. 8, there is shown the flowchart for the durability lowering suppression mode. This flowchart is used "rec flag=1" has been made in the flowchart of FIG. 4 or 5 (or FIG. 3) after completion NOx-regeneration or SOx-regeneration (or DPF-regeneration).

Figure 21:
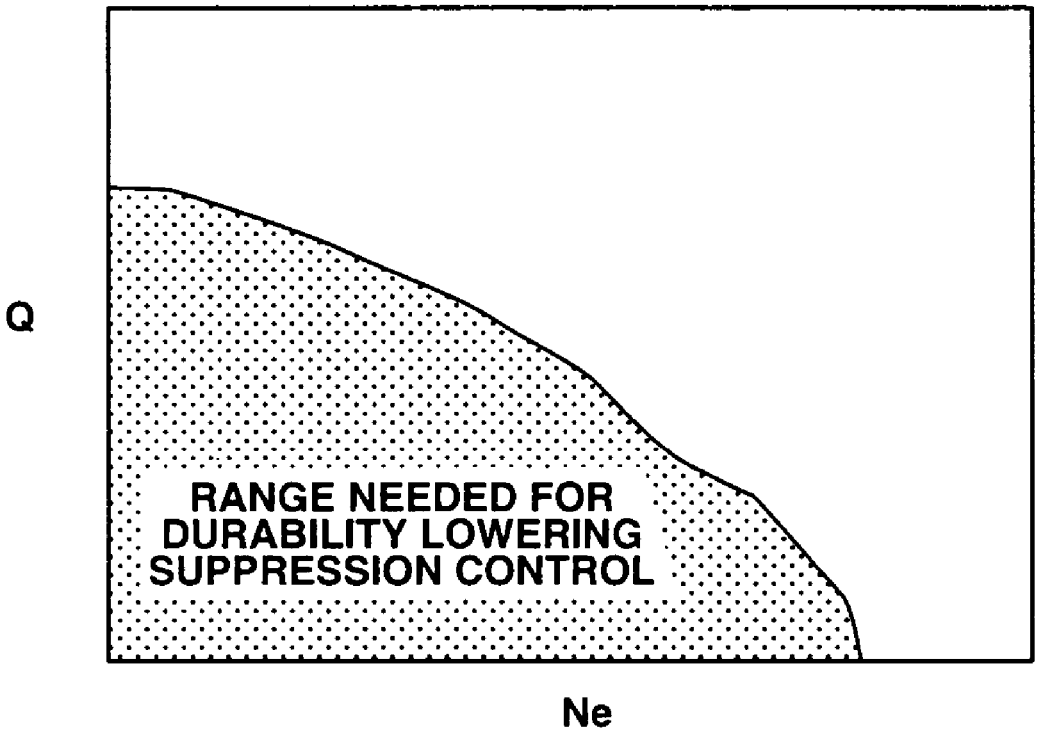
FIG. 21 is a map showing a zone where the control for suppressing lowering of the durability of the diesel particulate filter (DPF) is possible.

In the flowchart of FIG. 8, at step S601, with reference to a map of FIG. 21, judgment is carried out as to whether or not the current engine operation condition (viz., condition represented by Ne and Q) is within a range where the durability lowering suppression control is needed. If YES, that is, when the operation condition is within such range, the operation flow goes to step S602.

At step S602, the temperature of the diesel particulate filter (DPF) 14 is detected again.

At step S603, the target exhaust-λ is corrected or set in order that the particulate matter (PM) collected by the diesel particulate filter (DPF) 14 is not instantly burnt. This is because the step S603 takes place just after the stoichiometric or richer air/fuel ratio engine operation and the engine operation condition is within the range needed for the durability lowering suppression control. As has been mentioned hereinabove, instant burning of the particulate matter (PM) lowers or deteriorates the durability of the diesel particulate filter (DPF) 14.

Figure 19:
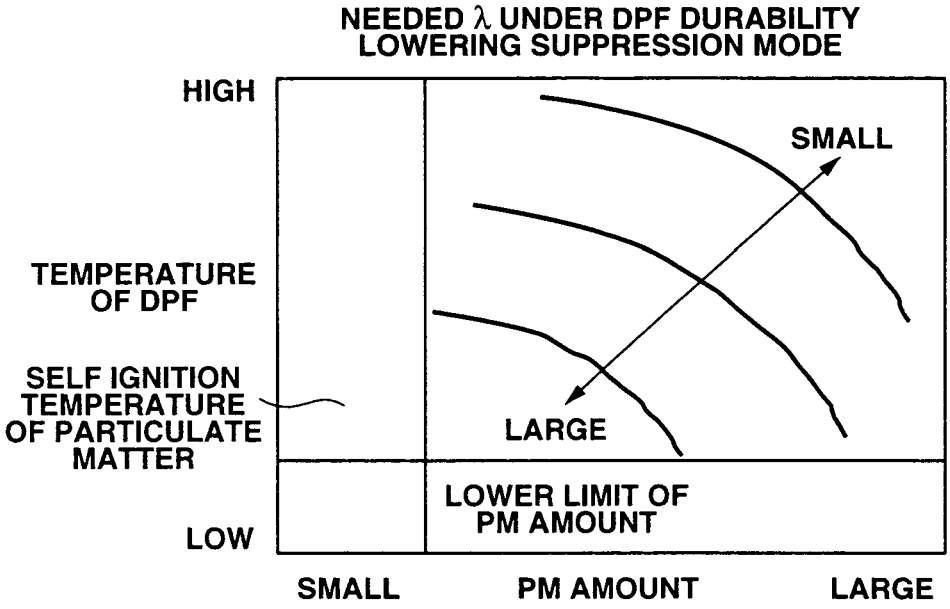
FIG. 19 is a map showing a needed λ (viz., target exhaust-λ) during the control for suppressing lowering of the durability of the diesel particulate filter (DPF)

Correction or setting of the target exhaust-λ is carried out with reference to a map of FIG. 19. That is, based on the amount of particulate matter (PM) derived at step S4 and the temperature of the diesel particulate filter (DPF) 14, the target exhaust-λ is set. As is seen from the map of FIG. 19, in case wherein the amount of the particulate matter (PM) collected and deposited is smaller than the lower limit and the temperature of the diesel particulate filter (DPF) 14 is lower than the self ignition temperature of the particulate matter (PM), there is no possibility that the particulate matter (PM) is instantly burnt. Thus, in such case, the above-mentioned setting of the target exhaust-λ based on the amount of collected particulate matter (PM) and the temperature of the diesel particulate filter (DPF) 14 is not carried out.

It is to be noted that the lower limit of the amount of the collected particulate matter (PM) and the self ignition temperature of the particulate matter (PM) have been previously obtained by carrying out suitable experiments. The actual control for achieving the target exhaust-λ is made by feedback-controlling the throttle valve 5 and/or EGR valve 12 based on the output from air/fuel ratio sensor 26.

In case just after the DPF-regeneration (for example, a case provided when "rec flag=1" of the flowchart of FIG. 3 is established), a control is so made that the target exhaust-λ is lower than for example 1.4 (viz., $\lambda \leqq 1.4$) for causing the oxygen concentration of the exhaust gas to be lower than a predetermined level. With this measure, even if any cinder of the particulate matter (PM) is left in the filter (DPF) 14, burning of the cinder is avoided and thus, durability of the filter (DPF) 14 is not lowered.

Referring back to the flowchart of FIG. 8, at step S604, judgment is carried out as to whether the temperature of the diesel particulate filter (DPF) 14 is lower than a predetermined temperature T3 or not. It is to be noted that the predetermined temperature T3 has been previously set by carrying out experiments in such a manner that the temperature T3 does not induce the instant or violent burning of the particulate matter (PM).

If YES at step S604, that is, when the temperature of the diesel particulate filter (DPF) 14 is lower than the predetermined temperature T3, the operation flow goes to step S605 estimating that there is no possibility of lowering the durability of the filter (DPF) 14 even if the oxygen concentration of the exhaust gas becomes generally equal to that in the atmosphere.

At step S605, the control for the target exhaust-λ is finished, that is, the durability lowering suppression mode is finished.

At step S606, "rec flag=0" is made because the durability lowering suppression mode has been finished.

In the following, advantages of the exhaust emission control system of the present invention will be described.

As will be described hereinabove, control unit 20 is arranged to function as an operation condition detecting means and an exhaust air/fuel ratio varying means. That is, by control unit 20, the amount of the particulate matter (PM) collected by and deposited on the diesel particulate filter (DPF) 14 is calculated. When the amount of the deposited particulate matter (PM) thus calculated is smaller than the lower limit, the durability lowering suppression control is not carried out. That is, only when the amount of the deposited particulate matter (PM) is larger than the lower limit, the target exhaust air/fuel ratio under the leaner air/fuel exhaust condition is set or varied in accordance with the condition of the diesel particulate filter (DPF) 14, that is, in accordance with the amount of the particulate matter (PM) collected by and deposited on the diesel particulate filter (DPF) 14 and/or the temperature of the diesel particulate filter (DPF) 14. Thus, the control for suppressing lowering of the durability of the diesel particulate filter (DPF) 14 can be carried out in a needed range without increasing an operation load of control unit 20 and influence to operation of engine 1. That is, the violent burning of the particulate matter (PM), which would cause a marked lowering of the durability of the diesel particulate filter (DPF) 14, can be avoided.

Furthermore, when the temperature of the diesel particulate filter (DPF) 14 is lower than the self ignition temperature of the particulate matter (PM), the durability lowering suppression control is not carried out. That is, only when the temperature of the diesel particulate filter (DPF) 14 is higher than the self ignition temperature, the target exhaust air/fuel ratio under the leaner air/fuel exhaust condition is set or varied in accordance with the condition of the diesel particulate filter (DPF) 14 (viz., the amount of deposited particulate matter (PM) and the temperature of the diesel particulate filter (DPF)). Accordingly, the control for suppressing lowering of the durability of the diesel particulate filter (DPF) 14 can be carried out in a needed range without increasing the operation load of control unit 20 and influence to operation of engine 1. That is, the undesired violent burning of the particulate matter (PM) can be avoided.

Furthermore, the target exhaust air/fuel ratio under the leaner air/fuel exhaust condition is set so that the oxygen concentration of the exhaust gas reduces as the amount of the collected particulate matter (PM) increases or as the temperature of the diesel particulate filter (DPF) 14 increases. Thus, the violent burning of the particulate matter (PM) can be assuredly avoided.

Furthermore, when engine 1 is under the durability lowering suppression control, the target exhaust air/fuel ratio under the leaner air/fuel combustion is varied. Thus, the durability lower suppression control for the diesel particulate filter (DPF) 14 can be carried out in the minimally needed range.

In the disclosed embodiment, there is employed a so-called EGR means, that includes EGR passage 11, EGR valve 12 and control unit 20. Accordingly, the control for the target exhaust air/fuel ratio can be made by controlling the EGR rate by EGR valve 12.

The entire contents of Japanese Patent Application 2003-137748 (filed May 15, 2003) are incorporated herein by reference.

Although the invention has been described above with reference to the embodiment of the invention, the invention is not limited to such embodiment as described above. Various modifications and variations of such embodiment may be carried out by those skilled in the art, in light of the above description.

What is claimed is:

1. In an internal combustion engine system comprising an exhaust purifying device arranged in an exhaust gas passage extending from the engine, the exhaust purifying device including a NOx trapping catalyst that traps NOx in the exhaust gas when an exhaust air/fuel ratio is leaner than stoichiometric and releases the trapped NOx therefrom when the exhaust air/fuel ratio is richer than stoichiometric, and a particulate filter that collects a particulate matter in the exhaust gas; a condition detecting device that detects an amount of the particulate matter that would be deposited on the particulate filter; and an exhaust air/fuel ratio control device that controls the exhaust gas from the engine in such a manner that the exhaust gas has a target exhaust air/fuel ratio, a method for controlling the exhaust air/fuel ratio control device comprising:

starting to increase the temperature of the particulate filter for burning the particulate matter in the filter when the amount of the deposited particulate matter detected by the condition detecting device reaches a predetermined amount; and varying the exhaust air/fuel ratio under the leaner air/fuel ratio exhaust condition in accordance with the detected amount of the deposited particulate matter upon sensing a change of the exhaust air/fuel ratio from a stoichiometric or richer side to a leaner side and sensing an excess of the detected amount of the deposited particulate matter over a predetermined lower limit.

2. An exhaust emission control system of an internal combustion engine, comprising:

an exhaust gas purifying device arranged in an exhaust gas passage extending from the engine, the exhaust purifying device including a NOx trapping catalyst that traps NOx in the exhaust gas when an exhaust air/fuel ratio is leaner than stoichiometric and releases the trapped NOx therefrom when the exhaust air/fuel ratio is richer than stoichiometric, and a particulate filter that collects a particulate matter in the exhaust gas;

a condition detecting device that detects an amount of the particulate matter that would be deposited on the particulate filter; and an exhaust air/fuel ratio control device that controls the exhaust gas from the engine in such a manner that the exhaust gas has a target exhaust air/fuel ratio, wherein the exhaust air/fuel ratio control device includes a first system that, when the amount of the deposited particulate matter detected by the condition detecting device reaches a predetermined amount, starts to increase the temperature of the particulate filter for burning the particulate matter in the filter, and wherein the exhaust air/fuel ratio control device further includes a second system that, upon sensing a change of the exhaust air/fuel ratio from a stoichiometric or richer side to a leaner side and sensing an excess of the detected amount of the deposited particulate matter over a predetermined lower limit, varies the exhaust air/fuel ratio under the leaner air/fuel ratio exhaust condition in accordance with the detected amount of the deposited particulate matter.

3. An exhaust emission control system as claimed in claim 1, in which the exhaust air/fuel ratio control device controls the target exhaust air/fuel ratio under the leaner air/fuel exhaust condition in such a manner as to lower an oxygen concentration in the exhaust gas as the amount of the deposited particulate matter increases.

4. An exhaust emission control system as claimed in claim 1, in which the exhaust air/fuel ratio control device varies the target exhaust air/fuel ratio under the leaner air/fuel exhaust condition when the engine is under a predetermined operation condition.

5. An exhaust emission control system as claimed in claim 1, in which the exhaust air/fuel ratio control device controls the exhaust air/fuel ratio to the target ratio by controlling an amount of intake air fed to the engine.

6. An exhaust emission control system as claimed in claim 1, in which the NOx trapping catalyst is arranged upstream of the particulate filter.

7. An exhaust emission control system as claimed in claim 1, in which the condition detecting device detects a temperature of the particulate filter, and in which the exhaust air/fuel ratio control device varies the target exhaust air/fuel ratio under the leaner air/fuel exhaust condition when the temperature of the particulate filter exceeds a predetermined temperature.

8. An exhaust emission control system as claimed in claim 7, in which the exhaust air/fuel ratio control device controls the target exhaust air/fuel ratio under the leaner air/fuel exhaust condition in such a manner as to lower an oxygen concentration in the exhaust gas as the temperature of the particulate filter increases.

9. An exhaust emission control system as claimed in claim 1, further comprising an EGR device that feeds a part of the exhaust gas of the engine back to an intake system of the engine.

10. An exhaust emission control system as claimed in claim 7, in which the exhaust air/fuel ratio control device controls the exhaust air/fuel ratio to the target ratio by controlling an amount of the exhaust gas fed back to the intake system of the engine.

11. An exhaust emission control system of a diesel engine, comprising:

a NOx trapping catalyst arranged in an exhaust gas passage extending from the engine, the NOx trapping catalyst trapping NOx in the exhaust gas when an exhaust air/fuel ratio is leaner than stoichiometric and releasing the trapped NOx therefrom when the exhaust air/fuel ratio is richer than stoichiometric;

a diesel particulate filter arranged in the exhaust gas passage at a position downstream of the NOx trapping catalyst, the diesel particulate filter collecting a particulate matter in the exhaust gas;

a first temperature sensor that detects a temperature of the NOx trapping catalyst;

a second temperature sensor that detects a temperature of the diesel particulate filter;

an exhaust pressure sensor that detects an exhaust pressure exerted in the exhaust gas passage between the NOx trapping catalyst and the diesel particulate filter;

an air/fuel ratio sensor that senses an exhaust air/fuel ratio of the exhaust gas discharged from the diesel particulate filter;

an exhaust air/fuel ratio controller that is adapted for varying the exhaust air/fuel ratio when operated; and a control unit that controls the operation of the exhaust air/fuel ratio controller by processing information signals from the first and second temperature sensors, the exhaust pressure sensor and the air/fuel ratio sensor, the control unit being configured to carry out;

upon sensing a change of the exhaust air/fuel ratio from a stoichiometric or richer side to a leaner side by the exhaust air/fuel ratio controller, varying the exhaust air/fuel ratio under the leaner air/fuel exhaust condition in accordance with at least one of the information signal from the second temperature sensor and the information signal from the exhaust pressure sensor.

* * * * *